United States Patent [19]

Clark et al.

[11] Patent Number: 5,047,674

[45] Date of Patent: Sep. 10, 1991

[54] GALLIUM ARSENIDE ANTENNA SWITCH HAVING VOLTAGE MULTIPLIER BIAS CIRCUIT

[75] Inventors: Edward T. Clark, Plantation; Enrique Ferrer, Miami, both of Fla.

[73] Assignee: Motorola, Inc., Schaumburg, Ill.

[21] Appl. No.: 517,899

[22] Filed: May 2, 1990

Related U.S. Application Data

[63] Continuation in part of Ser. No. 258,933, Oct. 17, 1988, abandoned.

[51] Int. Cl.[5] ..... H01P 1/15

[52] U.S. Cl. ..... 307/570; 307/242; 307/112; 455/277; 455/78; 333/103

[58] Field of Search ..... 307/570, 242, 243, 449, 307/463, 270, 446, 560, 112; 455/79, 83, 272, 277; 333/103, 104, 262

[56] References Cited

U.S. PATENT DOCUMENTS

| | | | |
|---|---|---|---|
| 3,887,872 | 6/1975 | Sharpe | 455/78 |
| 4,313,065 | 1/1982 | Yoshida et al. | 307/585 |
| 4,316,243 | 2/1982 | Archer | 307/261 |
| 4,367,421 | 1/1983 | Baker | 307/570 |
| 4,656,364 | 4/1987 | Yokogawa et al. | 333/103 |
| 4,761,822 | 8/1988 | Maile | 455/83 |
| 4,802,239 | 1/1989 | Ooto | 333/103 |
| 4,803,447 | 2/1989 | Schultz et al. | 333/103 |
| 4,920,285 | 4/1990 | Clark et al. | 333/103 |
| 4,987,392 | 1/1991 | Clark et al. | 333/103 |

OTHER PUBLICATIONS

Product Technology, Microwave Inc., Asbury Park, N.J., pp. 137 through 140 "MMIC Switch Couples Inputs From DC to 6 GHz", Microwaves & RF-Dec. 1987.

*Primary Examiner*—Timothy P. Callahan
*Attorney, Agent, or Firm*—Robert S. Babayi

[57] ABSTRACT

A voltage multiplier rectifier filter circuit comprising capacitors C3 and C4 and diodes D1 and D3 multiples, rectifies and filters the voltage at an input terminal (T1) of the switch. A diode (D2) is connected to the output of the multiplier-rectifier-filter circuit to provide a lesser bias voltage in the absence of a signal at the input terminal (T1). Four transistors (Q1-Q4) switch this bias voltage ON and OFF to the gates of four GaAs transistors (S1-S4). The GaAs transistors selectively couple signals between the input and output signal terminals (T1-T4) of the switch.

8 Claims, 1 Drawing Sheet

GALLIUM ARSENIDE ANTENNA SWITCH HAVING VOLTAGE MULTIPLIER BIAS CIRCUIT

This is a continuation in part of application Ser. No. 07/258,933 filed on 10/17/88 and now abandoned

BACKGROUND OF THE INVENTION

This invention pertains to electronic switches and, more particularly, to a Gallium Arsenide field effect transistor switch in which the bias voltage necessary to operate the GaAs transistors is produced from a voltage multiplier-rectifier-filter circuit which is powered from an input signal to the switch.

GaAs transistors have been used in electronic switches and are sometimes preferred over PIN diodes because these transistors can be integrated on a monolithic integrated circuit chip and because they dissipate negligible power in the ON state. GaAs transistors are usually preferred over other field effect transistors because of their high frequency operating characteristics. GaAs transistors, however, are depletion mode devices which require a negative bias voltage (for an N-channel device) between the gate and source terminals to switch the transistor to the OFF state. This usually requires an additional power supply to operate the switch.

The GaAs switch described below, however, eliminates the need for an addtional bias voltage supply. This invention uses a voltage multiplier, rectifier and filter circuits to derive the necessary bias voltage directly from an input signal to the switch.

SUMMARY OF THE INVENTION

Briefly, the invention is a switch that includes a first bias voltage means for multiplying the voltage of a signal at a first terminal of the switch, and for converting the signal to a first bias voltage. A second bias voltage means is also included for providing a second bias voltage in the absence of the signal at the first terminal. A first signal switching means couples the first terminal to a second terminal of the switch when the first signal switching means is ON. Similarly, a second signal switching means couples the second terminal to a third terminal when the second signal switching means is ON. A first bias switching means couples the first bias voltage to the first signal switching means when the first bias switching means is ON. In a similar manner, a second bias switching means couples the second bias voltage to the second signal switching means when the second bias switching means is ON.

In another embodiment, the invention includes the first and second bias voltage means described above. Also included in a first Gallium Arsenide (GaAs) transistor coupled between the first and second terminals, and a second GaAs transistor coupled between the second and third terminals. A first bias switching means couples the first bias voltage to the gate of the first transistor when the first bias switching means in ON. Similarly, the second bias switching means couples the second bias voltage to the gate of the second transistor when the second bias switching means is ON.

DESCRIPTION OF THE PREFERRED EMBODIMENT

Figure 1:
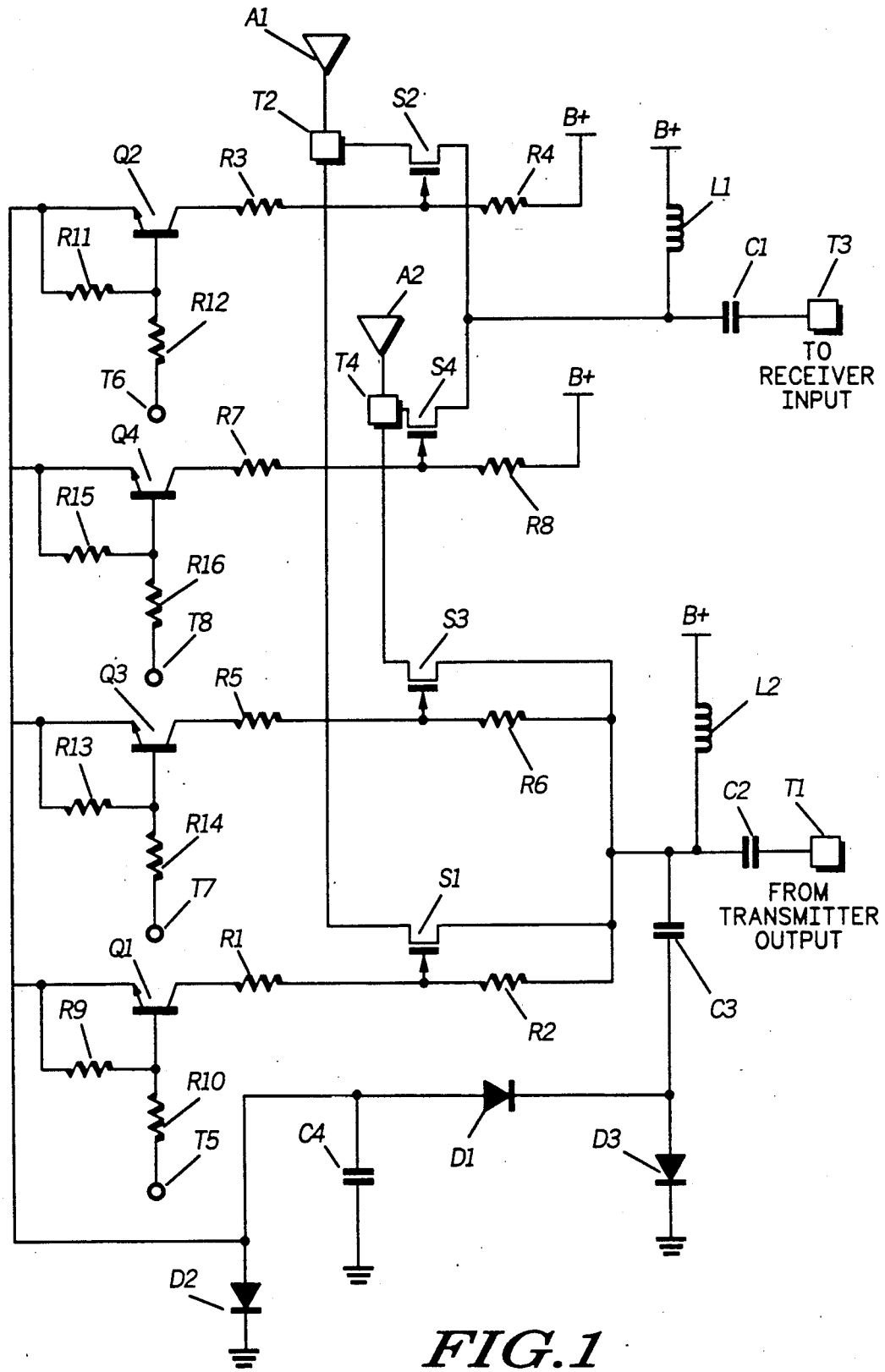
FIG. 1 is schematic drawing of the preferred embodiment of the present invention.

Referring to FIG. 1, transistor S1 and resisors R1 and R2 form a electronic switch that couples signals between a first terminal T1 and a second terminal T2 when transistor S1 is conducting (i.e., when the first switch is "closed"). In a similar manner, transistor S2 and resistors R3 and R4 form a second switch that couples signals between terminals T2 and T3 when transistor S2 is conducting, transistor S3 and resistors R5 and R6 form a third switch that couples signals between terminals T1 and T4 when transistor S3 is conducting, and transistor S4 and resistors R7 and R8 form a fourth switch that couples signals between terminals T3 and T4 when transistor S4 is conducting. These four switches shall be referred to as "signal" switches. Transistor S1–S4 are preferably Gallium Arsenide (GaAs) field effect transistors, although other transistor types may also be suitable.

Transistor Q1 and bias resistors R9–R10 form a bias voltage switch that couples the bias voltage at the anode of diode D2 to the gate of transistor S1 when transistor Q1 is conducting (i.e. when the bias voltage switch is closed). Similarly, transistor Q2 and resistors R11–R12 form a second bias voltage switch, transistor Q3 and resistors R13–R14 form a third bias switch, and transistor Q4 and resistors R15–R16 form a fourth. Transistors Q1–Q4 are preferably NPN bipolar transistors, although other types of transistors may also be suitable.

The sources of transistors S2 and S4 (transistors S1–S4 are presumed to be bidirectional divices; consequently, the distinction between the source and drain terminals is somewhat arbitrary) are coupled to terminal T3 through capacitor C1. Capacitor C1 is a DC blocking capacitor and its impedance at the operating frequency is selected to be very small. Inductor or choke L1 biases the sources of transistors S2 and S4 at the positive power supply voltage B+ and its impedance at the operating frequency is very large. Capacitor C2 and inductor L2 are similar to capacitor C1 and inductor L1, respectively.

As illustrated in FIG. 1, the preferred application of the present invention is as an antenna/transmitreceive switch. Consequently, antennas A1 and A2 are shown connected to terminal T2 and T4, respectively. In addition, a non-illustrated radio transmitter and receiver are respectively connected to terminals T1 and T3 in the preferred application.

Capacitors C3, C4 and diodes D1 and D3 form a well known voltage multiplier circuit. During the positive half cycle of the input signal at the junction of inductor L2 and capacitor C3, diode D3 conducts while at the same time diode D1 is cutoff. Therefore, the capacitor C3 is charged to the positive peak value of the non-illustrated transmitter signal. During the negative half cycle of the transmitter signal, diode D3 is cutoff and diode D1 conducts charging capacitor C4 to a voltage approximately equal to twice the negative peak voltage (twice the peak voltage less the voltage drop across the diodes D1 and D3). During the next positive half cycle, diode D1 is nonconducting and capacitor C4 will discharge through one of the loads R1–R16 depending on the status of the bias voltage switches. The capacitor C4 is recharged up to approximately twice the negative peak voltage during the following negative half cycle. Accordingly, when the transmitter signal is present, the voltage wave form across the capacitor C4 comprise a negative voltage being rectified by diode D1 and filtered by capacitor C4. The capacitor C3 is selected to provide adequate charge transfer to the capacitor C4, and the capacitor C4 is selected to provide acceptable ripple voltage. Collectively, voltage multiplier, rectifier and filter circuits provide a first bias voltage source that produces a relatively large negative bias voltage at the junction of capacitor C4 and diodes D1 and D2. In the absence of a signal at terminal T1 (i.e., when the transmitter is not transmitting, but the receiver is receiving), diode D2 pulls the output of this first bias voltage supply to within several tenths of a Volt of ground potential. Consequently, diode D2 provides a second bias voltage source. Preferably, diodes D1, D2 and D3 are Schottky diodes.

To receive on antenna A1, a non-illustrated controller places a positive voltage on terminals T5, T7 and T8 of sufficient magnitude to forward bias the base-emitter junctions of transistors Q1, Q3 and Q4. This switches transistors Q1, Q3 and Q4 ON, causing the bias voltage at the anode of diode D2 to be coupled to the gates of transistors S1, S3 and S4. Because there is no signal at terminal T1, the voltage multiplier rectifier-filter circuit is inoperative in this mode and diode D2 provides the bias voltage, which is a few tenths of a Volt above ground. Since the sources of transistors S1, S3 and S4 are pulled to B+ through either choke L1 or L2, the bias voltage at the gates of transistors S1, S3 and S4 is negative with respect to the source voltage. Accordingly, transistors S1, S3 and S4 are switched OFF.

In addition, the controller either open circuits terminal T6, or provides a voltage to terminal T6 that is insufficient to forward bias the base-emitter junction of transistor Q2. Consequently, transistor Q2 is switched OFF. Resistor R4 then biases the gate of transistor S2 at the same potential as the source of the transistor, thereby switching transistor S2 ON. When transistor S2 is conducting, a signal captured by antenna A1 is coupled to the input of the receiver at terminal T3.

To transmit on antenna A1, a positive voltage of sufficient magnitude to forward bias the base-emitter junctions of transistors Q2, Q3 and Q4 is applied to terminals T6, T7 and T8. This switches transistors Q2, Q3 and Q4 ON, and the bias voltage at the anode of diode D2 is coupled to the gates of transistors S2, S3 and S4. Consequently, transistors S2, S3 and S4 are switched OFF. Accordingly, the transistors Q1–Q4 control the switching action of the transistors S1–S4 by coupling the first or second bias voltages to their gate terminals.

Contrary to receive mode, the bias voltage in the transmit mode is developed by the voltage multiplier rectifier filter circuit comprising capacitors C3 and C4 and diodes D1 and D3. Since the magnitude of the bias voltage in the transmit mode is greater than it is in the receive mode (i.e., more negative), diode D2 is reversed biased and, as a result, diode D2 has no function in the transmit mode.

In addition, the controller either open circuits terminal T5 or applies a voltage of insufficient magnitude to forward bias the base-emitter junction of transistor Q1. Consequently, bias resistor R2 pulls the gate of transistor S1 to the same potential as the source and transistor S1 switches ON, such that the transmit signal at terminal T1 is coupled to antenna A1.

We claim as our invention:

1. A switch for coupling at least one terminal to a plurality of terminals, conprising in combination:
first bias voltage means of multiplying the voltage of a signal at a first terminal of said switch, and for converting said signal to a first bias voltage:
second bias voltage means for providing a second bias voltage in the absence of said at said first terminal;
first signal switching means for coupling said first terminal to a second terminal of said switch;
second signal switching means for coupling said second terminal to a third terminal of said switch;
first bias switching means for coupling said first bias voltage to said first signal switching means in response to first control signal; and
second bias switching means for coupling said second bias voltage to said second signal switching means in response to a second control signal.

2. The switch of claim 1, further comprising:
third signal switching means for coupling said first terminal to a fourth terminal of said switch;
fourth signal switching means for coupling said fourth terminal to said third terminal of said switch;
third bias switching means for coupling said first bias voltage to said third signal switching means in response to a third control signal; and
fourth bias switching means for coupling said second bias voltage to said fourth signal switching means in response to a fourth control signal.

3. A switch, comprising in combination:
first bias voltage means for multiplying the voltage of a signal at a first terminal of said switch, and for converting said signal to a first bias voltage:
second bias voltage means for providing a second bias voltage in the absence of said signal at said first terminal;
a first GaAs transistor switch coupled between said first terminal and a second terminal of said switch;
a second GaAs transistor switch coupled between said second terminal and a third terminal of said switch;
first bias switching means for coupling said first bias voltage to a gate of said first GaAs transistor switch in response to a first control signal; and
second bias switching means for coupling said second bias voltage to a gate of said second GaAs transistor switch in response to a second control signal.

4. The switch of claim 3, further comprising:
a third GaAs transistor switch coupled between said first terminal and a fourth terminal of said switch;
a fourth GaAs transistor switch coupled between said fourth terminal and said third terminal of said switch;
third bias switching means for coupling said first bias voltage to a gate of said third GaAs transistor switch in response to a third control signal; and
fourth bias switching means for coupling said second bias voltage to the gate of said fourth GaAs transistor switch in response to a fourth control signal.

5. The switch of claim 3, further comprising:
a first bias resistor coupled between the gate of said first GaAs transistor switch and said first terminal; and
a second bias resistor coupled between the gate of said second GaAs transistor switch and a power supply terminal.

6. The switch of claim 3, wherein said second bias voltage means includes a diode coupled between the output of said first bias voltage means and a power supply terminal.

7. The switch of claim 4, further comprising:

a first bias resistor coupled beteen the gate of said first GaAs transistor switch and said first terminal; and a second bias resistor coupled between the gate of said second GaAs transistor switch and a power supply terminal.

8. The switch of claim 4, wherein said second bias voltage means includes a diode coupled between the output of said first bias voltage means and a power supply terminal.

* * * * *